US007342477B2

(12) United States Patent
Brandt et al.

(10) Patent No.: US 7,342,477 B2
(45) Date of Patent: Mar. 11, 2008

(54) INDUCTOR

(75) Inventors: Randy L. Brandt, Orange, CA (US); H. Bruce Turner, Huntington Beach, CA (US)

(73) Assignee: The Boeing Company, Chiacgo, IL (US)

( * ) Notice: Subject to any disclaimer, the term of this patent is extended or adjusted under 35 U.S.C. 154(b) by 87 days.

(21) Appl. No.: 11/173,530

(22) Filed: Jul. 1, 2005

(65) Prior Publication Data

US 2007/0001795 A1 Jan. 4, 2007

(51) Int. Cl.
*H01F 5/00* (2006.01)

(52) U.S. Cl. ..... 336/200

(58) Field of Classification Search ..... 336/200
See application file for complete search history.

(56) References Cited

U.S. PATENT DOCUMENTS 3,372,358 A * 3/1968 Roy et al. ..... 336/200
5,534,837 A 7/1996 Brandt ..... 336/155
5,802,702 A * 9/1998 Fleming et al. ..... 29/608
6,980,074 B1 * 12/2005 Jitaru ..... 336/200

OTHER PUBLICATIONS

"Inductance Modeling for a Mode-2 perforated-Plate Matrix Inductor/transformer", by S. Kirli, K.D.T. Ngo, W.M. Polivka, and M.M. Walters, IEEE Annual Power Electronics Specialists Conference 1993, pp. 1131-1136.

* cited by examiner

*Primary Examiner*—Elvin Enad
*Assistant Examiner*—Joselito S. Baisa
(74) *Attorney, Agent, or Firm*—Armstrong Teasdale LLP

(57) ABSTRACT

An inductor comprising one or more windings disposed on opposed first and second surfaces of a flat-plate substrate. The windings are applied to the substrate by plating or photoresistive deposition techniques, with through-holes through the plate accommodating the windings from opposed surfaces. Windings of more than one layer are obtainable with insulation between adjacent layers. The resulting inductor is usable, for example, as a component of an EMI filter in a power converter circuit.

12 Claims, 4 Drawing Sheets

INDUCTOR

FIELD OF THE INVENTION

The present invention relates in general to magnetic components, and relates more particularly to inductors having magnetic cores for use in electronic applications such as power conditioning circuits and DC-DC converters.

BACKGROUND OF THE INVENTION

Numerous modern-day electrical circuits utilize magnetic core components in accomplishing desired objectives. Audio and alternating current (AC) transformers and inductors typically include iron, powdered iron, or ferrite magnetic substrates. While the precise composition of such substrates varies with respect to design goals, common form structures take the shape of rods, toroids, or pot cores having single or multiple winding coils integral thereto. The windings in conjunction with the magnetic substrate define the operating parameters of the device. Such structures are typically bulky and their physical dimensions often define the minimum size requirement of associated devices or subsystems.

Recently, low-profile substrates have become more popularly known, often taking the form of a flat monolithic substrate with vias or through holes for plated or hard wire windings. One example of such a device may be found in U.S. Pat. No. 5,534,837 issued Jul. 9, 1996 to Randy L. Brandt and incorporated herein by reference. The use of low-profile perforated plates for magnetic core substrates was hampered, in part, due to inaccuracies in modeling the inductance of such devices. Conventional modeling approaches proved inaccurate in view of the non-conventional structure. Although numerous combinations were possible, empirical formulas have been devised and published addressing such modeling issues. One such publication is a paper entitled "Inductance Modeling for a Mode-2 Perforated-Plate Matrix Inductor/Transformer", by S. Kirli, K. D. T. Ngo, et al, IEEE Annual Power Electronics Specialists Conference 1993, pages 1131-1136.

Power conditioning networks, particularly magnetic components of EMI filters, use one or more inductors to accomplish necessary system objectives. Traditionally, the EMI filter magnetic functionalities are separated into two or more inductors, i.e., the first inductor in conjunction with the circuit bulk capacitance provides the differential mode (DM) filtering functionality, while the second inductor (typically a coupled choke) in conjunction with common mode (CM) capacitance provides the CM filter functionality. In high-power EMI filters, the multiple inductors associated with the conventional approach are large and weighty, and consume significant volume of the power supply containment space.

As power converters and their associated circuits become more complex, it is desirable to be able to reduce the occupied volume and form factor variabilities of the magnetic components. Consequently, there exists a need for low-profile inductors of high reliability and low cost.

SUMMARY OF THE INVENTION

Inductors according to the present invention include a low-profile magnetically permeable substrate with at least one winding magnetically coupled to the substrate. The winding or windings are disposed through an arrangement of through-holes in the substrate. The windings may be plated or wired, and preferably are integral to the substrate and wound geometrically parallel to each other. Multiple windings on a common substrate may have the same polarizations with an appropriate winding separation.

Inductors according to the present invention comprise a single structure flat-plate magnetic core design that is intrinsically robust, easier to cool, and less likely to be damaged or destroyed when exposed to mechanical stresses. For EMI filter applications, the inductor structure may embody both differential and common mode functionalities situated on a single integrated flat plate core capable of electrical enhancements, for example, high-frequency inductors integrated and added to the common plate shared with low-frequency inductors, not possible with the prior art. Flat plate design, dimensional separation, and inductor winding polarizations allow these integrated inductors to function as though the inductors were detached from their common substrate, thereby providing small, low cost, lightweight multiple inductor functionalities that consume less assembly time.

Stated somewhat more particularly and respect to a disclosed embodiment, a first winding comprises an AC inductor intended for connection in series with the high side of a power converter circuit. A second and any subsequent windings of the preferred embodiment comprise additional AC inductors and are intended to be electrically connected in series with the return side of the power converter circuit.

Further, integrating the EMI filter magnetics as part of a printed wiring board assembly provides additional size reduction benefits.

A preferred embodiment of an inductor according to the present invention comprises a low-profile core of manganese-zinc ferrite composition with copper-plated through wires or copper wires deposited in accordance with photoresistive deposition techniques known to those skilled in the art, which insulate subsequent wire layers of a winding from each other while providing a plurality of windings and associated interconnects within a highly confined area.

Accordingly, it is an object of the present invention to provide a low profile electromagnetic device.

It is another object of this invention to provide flat plate electromagnetic devices intended for use with low-profile high power-density EMI filter and dc-dc converter circuits.

It is another feature of this invention to minimize the material volume while preventing core saturation due to DC currents.

It is another object of the present invention to provide a set of inductors that manifest themselves as discrete components although physically sharing the same flat core.

It is to be understood that both the foregoing general description and the following detailed description are exemplary and explanatory only and are not restrictive of the invention as claimed. The numerous objects and advantages of the present inductor may be better understood by those skilled in the art by reference to the embodiments described herein.

BRIEF DESCRIPTION OF THE DRAWINGS

FIG. 2 is a fragmentary pictorial view taken along line 2-2 of FIG. 1 and partially broken away for illustrative purposes.

DETAILED DESCRIPTION OF DISCLOSED EMBODIMENTS

Figure 1:
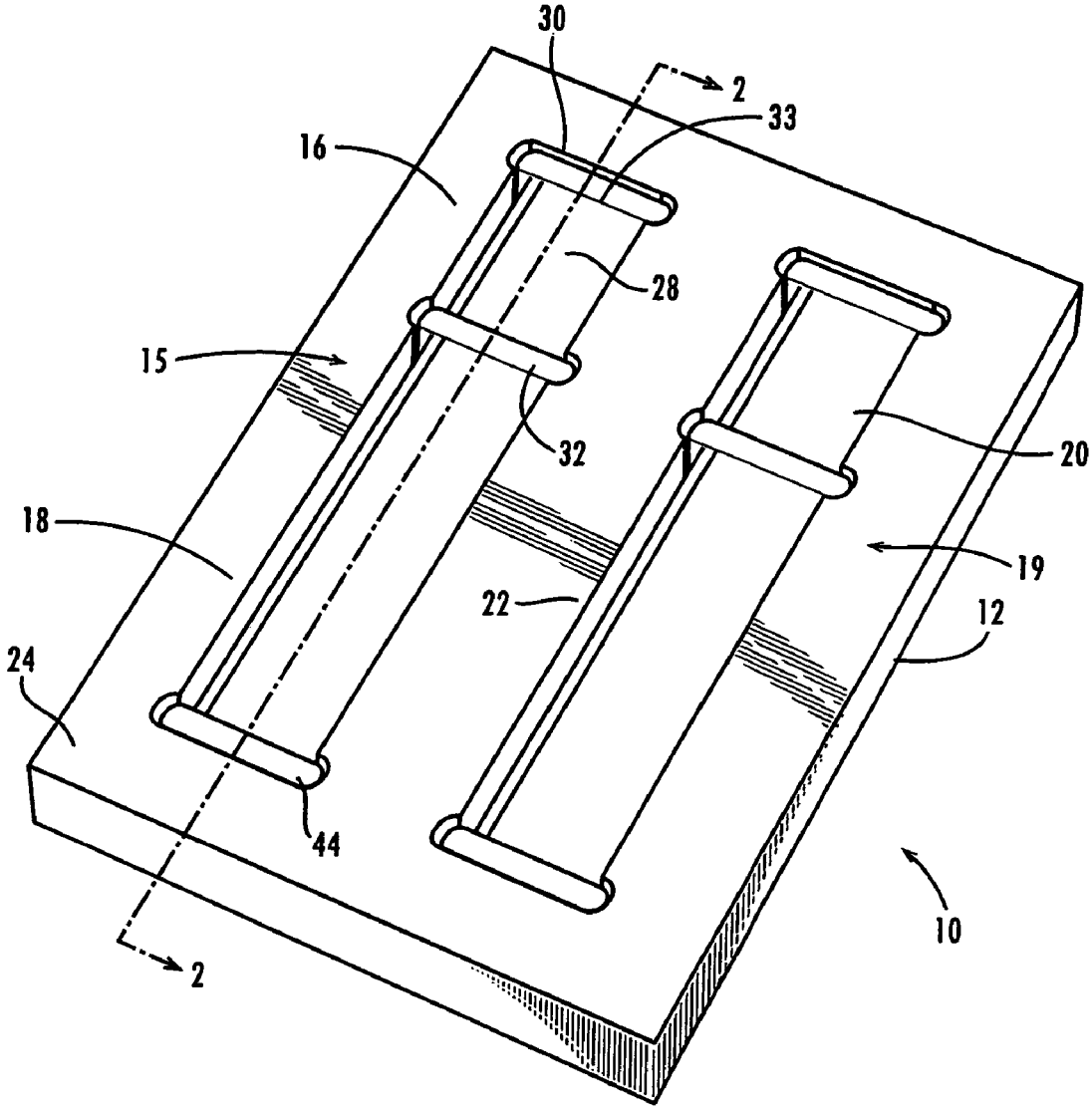
FIG. 1 is a pictorial view showing an inductor according to an embodiment of the present invention.
Figure 7:
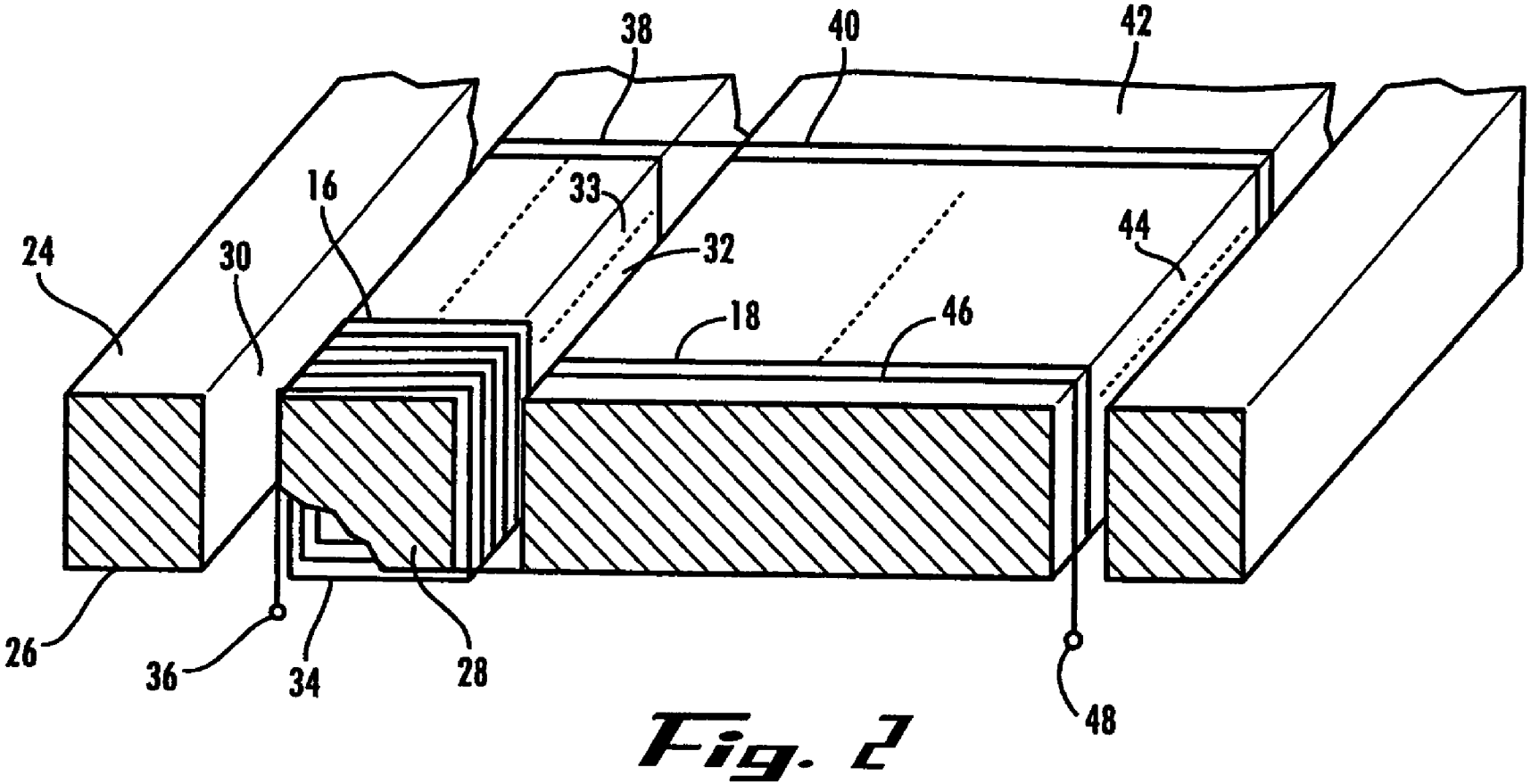

Turning first to FIG. 1, there is shown generally at 10 a flat-plate inductor according to a disclosed embodiment of the present invention. The inductor 10 comprises a plurality of windings described below in further detail, disposed on a magnetic substrate 12 in the form of a flat plate. The substrate 12 is comprised of a manganese-zinc ferrite composition, in a disclosed embodiment of the inductor. The several windings are disposed on the substrate by techniques known in the art, such as copper plating onto the substrate or copper wires deposited in accordance with photoresistive deposition techniques. In the case of multiple-layer windings of the inductor 10, individual conductor layers are insulated from each other in accordance with known photoresistive deposition techniques, thereby providing a plurality of winding layers on the substrate 12.

The inductor 10 of the disclosed embodiment contains two set of windings. The first set 15 of windings comprises a first winding 16 and a second winding 18 connected in series with the first winding, and the second set 19 of windings comprises a third winding 20 in series with a fourth winding 22. The conductors making up all four windings are in substantially parallel alignment with each other on an axis of the substrate 12 and are substantially parallel with the upper surface 24 and lower surface 26 of the substrate, as shown in FIG. 2. Each winding 16 . . . 22 comprises at least one layer of an electrical conductor wound around a core comprising part of the substrate 12 and extending part-way across the substrate on a direction substantially perpendicular to the linear spacing of the windings.

The arrangement of the first winding 16, best seen in FIG. 2, illustrates the construction and arrangement of that winding in the disclosed embodiment. The winding 16 comprises conductors disposed on and extending around a core 28 comprised by a portion of the substrate 12 and defined along two sides by through-holes 30 and 32 extending through the thickness of the substrate. Each through-hole is elongated in a direction that extends part-way across the width of the substrate 12, and the through holes communicate with the upper surface 24 and the lower surface 26 of the substrate to provide a path for the turns 34 of the conductor making up the first winding 16.

The spacing between the through-holes 30 and 32 defines the length of each turn 34 of the winding 16. Referring to FIG. 1, it is seen that the second winding 18 extends between one through hole 32 for the first winding and another elongated through hole 44 spaced apart from the through hole 32 and parallel therewith along the substrate 12. The spacing between the through holes 32 and 44 is substantially greater than the spacing between the through holes 30 and 32 of the first winding 16 in the disclosed embodiment, although it should be understood that the relative distances between through holes is determined by the characteristics desired for the respective windings and are not critical to the present invention.

As best seen in FIG. 2, the turns 34 are plated or otherwise disposed on the upper and lower surfaces of the core 28, and on the core sides 33 of the through holes 30 and 32 extending between those upper and lower surfaces. Each turn 34 is substantially coplanar with the flat upper and lower surfaces of the substrate, with adjacent turns being slightly offset so that the winding 16 has can be described as an orthogonal helix or spiral having an axis extending along the length of the core 28, that is, substantially parallel to the direction of elongation of the through holes. The extent of the core length and the width of each individual turn of the winding 16 determine the maximum number of turns making up one layer of the first winding 16. The number of such turns, and the length of each turn along the upper surface 24 and lower surface 26 of the substrate, determine the inductance of the first winding, as will be understood by those skilled in the art.

Referring again to FIG. 2, it is seen that an initial turn 34 of the winding 16 terminates at an external connection point 36, which may be provided by a conductive pad or other element plated or deposited onto a surface of the substrate 12. The final turn 38 of the winding 16 extends across the upper surface 24 of the substrate 12 to join the first turn 40 of the second winding 18. Subsequent turns of the second winding 18 extend spiral-wise along the core 42 extending along the substrate 12 and defined by the through-holes 32 and 44. The final turn 46 of the second winding 18 terminates in another connection point 48 permitting external connection with the second winding.

It will thus be understood that the first winding 16 and second winding 18 are in series with each other and are of the same polarity. Each of the first and second windings thus comprises an AC inductor, with the two inductors connected in series with each other. The length of the turns making up the second winding 18 is substantially greater than that of the turns making up the first winding 16, in the disclosed embodiment with the result that the inductance (and the corresponding impedance at a given AC frequency) is greater for the second winding.

Each winding 16 and 18, as described above, comprises a single layer of winding turns 34 around the core 28. The maximum number of turns of each winding 16 and 18 is thus determined by the length of the respective cores 28 and 42 for those windings, as well as the width of each turn across the core and the spacing between successive turns of the windings. However, as previously mentioned, inductors according to the present invention may have one or more windings comprising multiple layers of winding turns, an alternative depicted in FIG. 3. In that figure, a winding 16*a* comprises a first layer of turns 34*a* extending along the core 28, and at least one additional layer of turns 34*b* is superimposed on top of the first layer 34*a*. An insulating layer 54 is interposed between the innermost first layer 34*a* and the next layer 34*b*, insulating the two conductor layers from each other. Although FIG. 3 shows only two layers of turns for the winding 16*a*, it should be understood that more than two layers separated by appropriate insulation layers may be disposed on the core for one or more windings according to the present invention.

Figure 3:
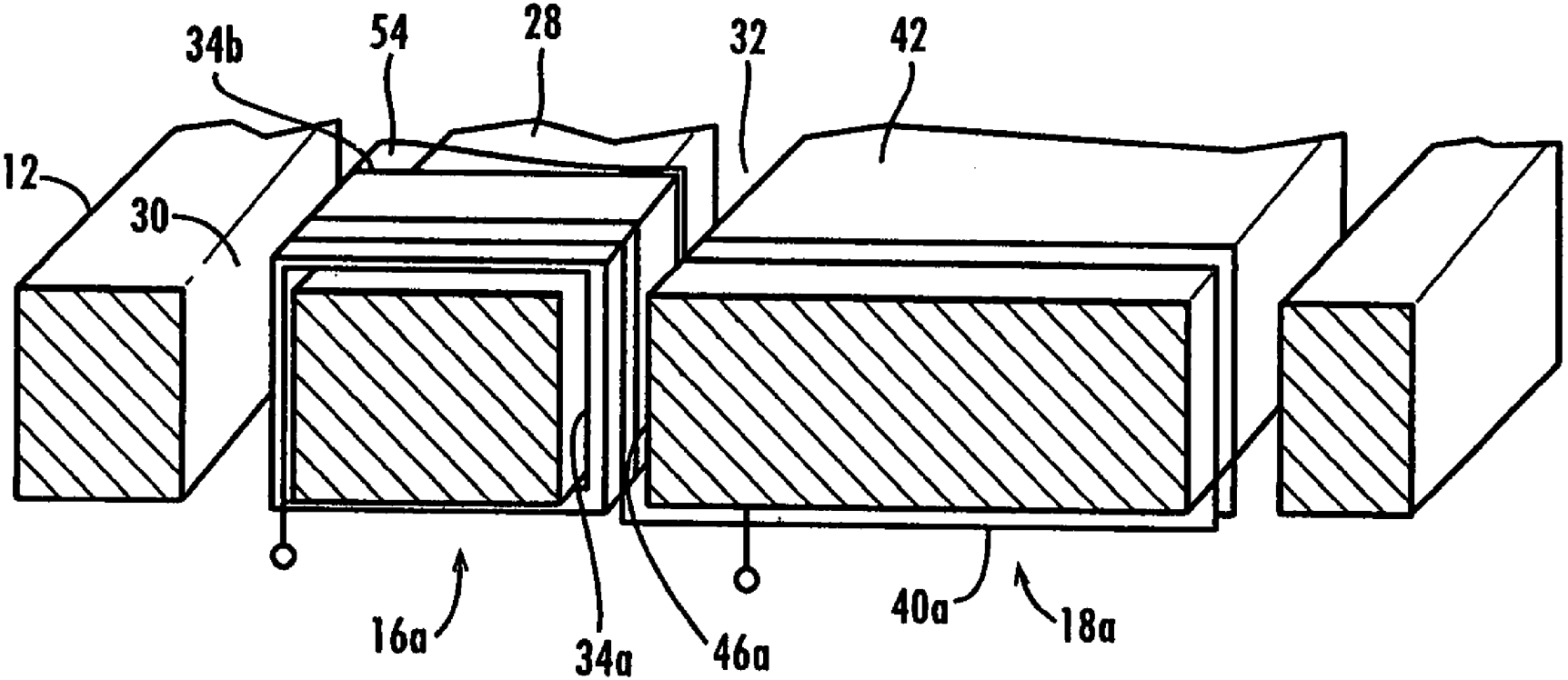
FIG. 3 is a schematic sectioned view showing a multilayer winding and two series-connected windings connected in opposed magnetic relation, according to modifications of the embodiment in FIG. 1.

FIG. 3 also illustrates another alternative embodiment in which a second winding 18*a* is connected in series with the first winding 16*a*, but of the opposite polarity relative to the first winding. With that modification, the final turn 46*a* of the winding 16*a* extends through the through-hole 32 separating the windings 16*a* and 18*a*, and then extends along the underside of the core 42 to comprise the first turn 40*a* of the winding 18*a*. The magnetic field induced in the core 42 by current flowing through the winding 18*a* thus has polarity opposite to the field induced in the core 28 by the first winding 16*a*.

Referring again to FIG. 1, it is seen that the third winding 20 and the fourth winding 22, making up the second set of windings 19, are substantially parallel to the first and second windings 16 and 18 and are laterally spaced apart from those first and second windings. The physical and electrical characteristics of the third winding 20 and the fourth winding 22 may, in the disclosed embodiment, by substantially the same as those of the first and second windings 16 and 18, although it should be understood that physical or electrical identities of the sets of windings 15 and 19 are not a critical part of inductors according to the present invention.

Figure 4:
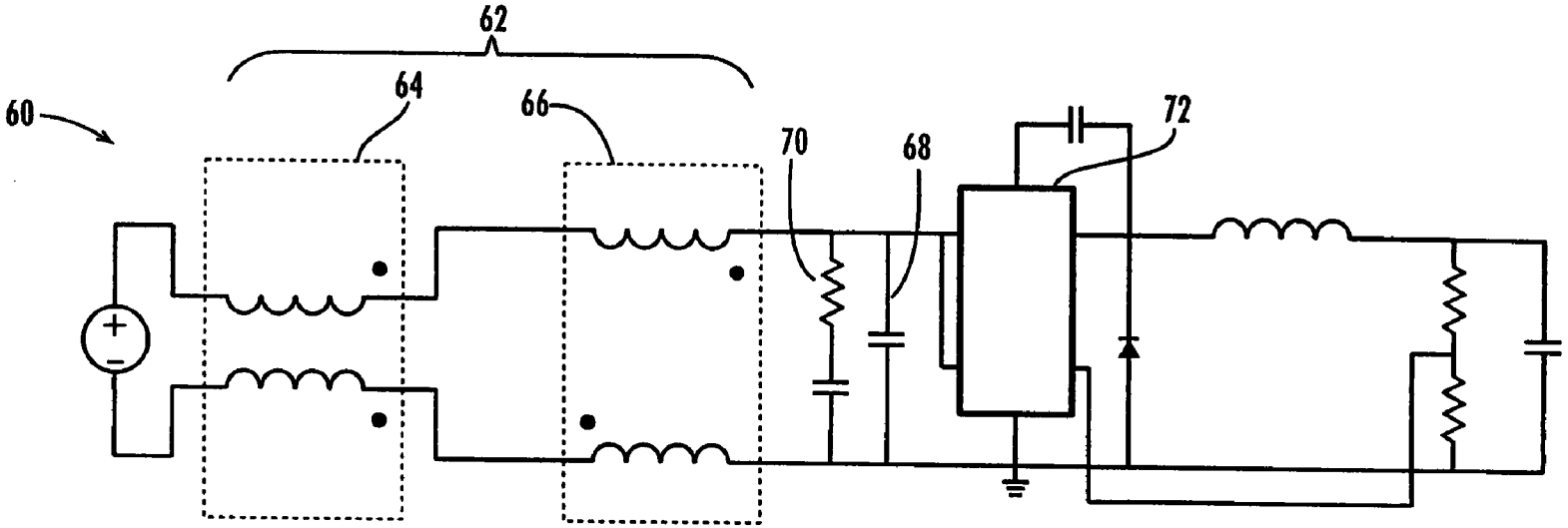
PRIOR ART Fig. 4
FIG. 4 is a schematic view illustrating a typical prior-art EMI filter in conjunction with a bulk dc-dc converter.

An exemplary application is now discussed for an inductor according to the disclosed embodiment. Referring first to FIG. 4, a typical DC-DC bulk power converter 60 is depicted showing a conventional approach to EMI filtering. The converter 60 receives a DC input voltage at the input terminals to the input EMI filter 62. EMI filter 62 comprises a common mode filter power choke 64 and a differential mode power choke 66, connected in association with a bulk capacitor 68 in parallel with an R-C damping network 70, providing energy transfer from the DC input source to the pulse-width-modulated switched DC-DC converter 72. Further details concerning the construction and operation of such power converters are known in the art and are not further discussed herein.

In the conventional design of such power converters, the common mode choke 64 and the differential mode choke 66 each comprise a pair of inductor windings magnetically coupled to a common core. Toroidal cores having dual windings with appropriate polarity are used for each choke in typical applications according to the prior art.

Figure 5:
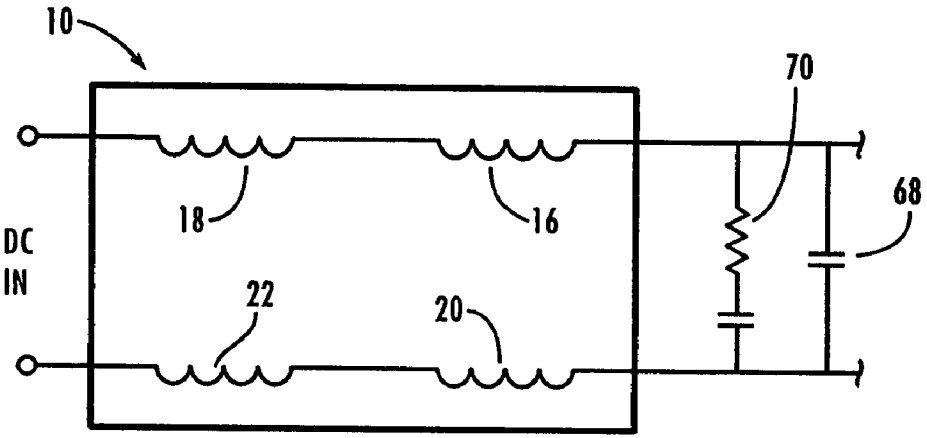
FIG. 5 is a partial schematic diagram illustrating an EMI filter using an inductor according to an embodiment of the present invention, substituted for the conventional inductors in the filter of FIG. 4.

Referring next to FIG. 5, a flat-plate inductor 10 as herein described is substituted for the EMI filter 62, including the common mode choke 64 and the differential mode choke 66, in the power converter 60 as otherwise described with regard to FIG. 5. In that substitution, the first winding 16 and the second winding 18 of the inductor 10 are in series between the high side of the DC input voltage and one side of the bulk capacitor 68 and R-C filter 70 leading to the DC-DC converter 72 (not shown in FIG. 5). On the low or return side of the input voltage, the third winding 20 and the fourth winding 22 of the inductor 10 are connected in series between the DC input source and the low side of the bulk capacitor 68 and R-C filter 70. The single flat-plate inductor 10 thus replaces the common mode choke 64 and the differential mode choke 66 in the conventional EMI filter shown in FIG. 4. Because the separate windings on the inductor 10 physically share the same flat core, instead of requiring separate toroidal cores as in the circuit of FIG. 4, the overall physical profile and volume of the converter 60 is reduced by substitution of the inductor 10 as shown in FIG. 5.

The flat-plate inductor 10, for the disclosed EMI filter application, embodies both differential common mode functionalities situated on a single flat plate, producing functionality not possible with chokes of the prior art. Appropriate choice of flat plate design, dimensional separation of windings, and inductor winding polarities allow integrated inductors according to the present invention to function as though they were detached from their common substrate, therefore providing small, low cost, and lightweight multiple inductor functionalities that require less assembly time, although physically sharing the same flat-plate core substrate. In an EMI filter application, it is possible to utilize characteristics of maximum leakage inductance as provided by appropriate separation of the integral copper-winding coils on a perforated flat magnetic core substrate. Separation of the upper-side coils 16 and 18 from the lower side coils 20 and 22 is sufficient to maintain the AC permeability of the core, while the DC component between the upper and lower sides is substantially cancelled so as not to saturate the core due to the different directions of the current flowing through the upper and lower sides of the inductor 10 in the circuit arrangement shown by FIG. 5. The present design thus permits minimizing the material volume of the core structure while preventing core saturation due to DC currents.

Inductors according to the present invention provide a packaging foundation for incorporating all the electronic control and sense circuitry integral to the application of the paired magnetic inductors. Furthermore, characteristics of maximum leakage inductance can be provided by ample separation of the integral winding coils on the perforated flat soft-magnetic core of the substrate, which is readily achievable as a minimum volume structure according to the present invention.

It should be understood that the foregoing relates only to prefer embodiments of the present invention and that modifications thereof may be made without departing from the spirit and scope of the invention as defined in the following claims.

The invention claimed is:

1. An Inductor comprising:

a low-profile magnetically permeable substrate;

a first set of windings magnetically coupled to the substrate and producing a first resultant magnetic field in response to an input signal applied to the first set of windings;

a second set of windings magnetically coupled to the substrate and having a second magnetic field in response to an input signal applied to the second set of windings;

the first and second sets of windings being disposed on the substrate in magnetically uncoupled relation with each other and such that the resultant fields are substantially mutually parallel;

each set of windings comprises a first winding and a second winding in series with the first winding; and the first and second windings of each set are magnetically coupled to the substrate, so that the first winding and second winding each comprise a pair of inductors connected in series; and the inductance of the first winding of each set of windings is greater than the inductance of the second winding of each set, so that the impedance of the first winding is greater than the impedance of the second winding in response to an AC signal applied to the set of windings.

2. Apparatus as in claim 1, wherein:

the first and second sets of windings are parallel to each other on the substrate and are laterally spaced apart from each other on the substrate.

3. Apparatus as in claim 1, wherein:

the first and second sets of windings are disposed on the substrate in magnetically uncoupled relation with each other, so that each set of windings in combination with the substrate comprises an inductor magnetically uncoupled from the other set of windings.

4. An electromagnetic device comprising:

a low-profile magnetically permeable substrate;

a first set of through openings in the substrate and disposed in predetermined alignment on the substrate;

a second set of through openings in the substrate and disposed in an alignment laterally spaced apart from and substantially parallel with the alignment of the first set of openings;

a first set of windings disposed in the first set of openings and magnetically coupled to the substrate;

a second set of windings disposed in the second set of openings and magnetically coupled to the substrate;

the first and second set of windings are mutually parallel and laterally spaced apart on the substrate and positioned so as to minimize magnetic coupling between the first and second set of windings;

at least one set of through openings comprises a first opening and a second opening spaced apart from the first opening along a first dimension of the substrate, and a third opening spaced apart from the second opening along the first dimension of the substrate;

the set of windings disposed in the at least one set of through openings comprises a first winding extending between the first and second openings in magnetically coupled relation with the substrate between the first and second openings, and a second winding in series with the first winding and extending between the second and third openings in magnetically coupled relation with the substrate between the second and third openings, so that the first and second windings comprise a pair of inductors.

5. The device as in claim 4, wherein;

the first and second sets of windings are disposed on the substrate in substantially magnetically uncoupled relation with each other, so that each set of windings in combination with the substrate comprises an inductor substantially magnetically uncoupled from the other set of windings.

6. The device as in claim 4, wherein:

at least one set of windings comprises a plurality of electrical conductors wound through the corresponding set of openings and laying substantially flat on respective surfaces of the substrate between the openings of the corresponding set of openings.

7. The device as in claim 6, wherein:

the plural electrical conductors making up the at least one set of windings are disposed alongside each other in a substantially flat array parallel to the surfaces of the substrate comprising at least one layer of the conductors.

8. The device as in claim 4, wherein:

at least one of the windings comprises plural layers of conductors, with each layer being electrically insulated from each other layer and with the layers being substantially parallel to the surfaces of the substrate.

9. The device as in claim 4, wherein:

the through openings are elongated along a second dimension of the substrate substantially perpendicular to the first dimension, with the substrate between the first and second openings comprising a core for the first winding and the substrate between the second and third through holes comprising a core for the second winding.

10. The device as in claim 9, wherein:

the first and second windings lay substantially flat on the corresponding sides of the substrate, with consecutive turns of the windings being substantially mutually parallel along the cores.

11. The device as in claim 4, wherein:

the first, second, and third openings are aligned along a linear path on the substrate;

the first winding is at a first location along the linear path and the second winding is at a second location along the linear path; and the first and second locations are positioned along the linear path so as to minimize magnetic coupling between the first and second windings.

12. The device as in claim 4, wherein:

the separation between the first opening and the second opening through the substrate is greater than the separation between the second opening and the third opening, so that the amount of magnetic coupling between the substrate and a conductor of the first winding is greater than the amount of magnetic coupling between a conductor of the second winding.

* * * * *